US007365277B2

(12) United States Patent
Wang

(10) Patent No.: US 7,365,277 B2
(45) Date of Patent: Apr. 29, 2008

(54) BUFFER ASSEMBLY FOR A PRESSURE SENSITIVE SWITCH

(76) Inventor: Cheng-Chung Wang, 9F, No. 24, Songjhih Rd., Sinyi Dist., Taipei (TW)

( * ) Notice: Subject to any disclaimer, the term of this patent is extended or adjusted under 35 U.S.C. 154(b) by 120 days.

(21) Appl. No.: 11/427,802

(22) Filed: Jun. 30, 2006

(65) Prior Publication Data

US 2007/0006387 A1 Jan. 11, 2007

(30) Foreign Application Priority Data

Jul. 7, 2005 (CN) ..... 2005 1 0035692

(51) Int. Cl.
*H01H 35/40* (2006.01)

(52) U.S. Cl. ..... 200/82 R; 200/83 J

(58) Field of Classification Search .. 200/61.22–61.26, 200/82 R, 83 A–83 D, 83 J
See application file for complete search history.

(56) References Cited

U.S. PATENT DOCUMENTS 4,194,103 A * 3/1980 Smith ..... 200/456
4,220,836 A * 9/1980 Hersey ..... 200/83 P
4,524,255 A * 6/1985 Haag ..... 200/83 R
4,939,321 A * 7/1990 Tanaka et al. ..... 200/83 P
4,998,087 A * 3/1991 Boulanger ..... 337/354
5,198,631 A * 3/1993 Hogue et al. ..... 200/83 P
5,308,939 A * 5/1994 Sasaki ..... 200/83 R
5,672,049 A * 9/1997 Ciurlo ..... 417/44.1
5,814,779 A * 9/1998 Verras et al. ..... 200/83 P
5,932,857 A * 8/1999 Stander et al. ..... 200/83 B
6,329,619 B1 * 12/2001 Koguchi ..... 200/83 J
6,522,252 B2 * 2/2003 Horibe et al. ..... 340/544
6,525,286 B2 * 2/2003 Koguchi et al. ..... 200/83 Y
7,256,361 B1 * 8/2007 Lee ..... 200/83 R

* cited by examiner

*Primary Examiner*—Elvin Enad
*Assistant Examiner*—Lisa Klaus

(57) ABSTRACT

A buffer assembly includes a housing adapted to sealingly connected to the pressure switch and defining therein a chamber and an airway defined in a bottom face of the housing to communicate with an interior of the housing so as to communicate with an inlet of the pressure switch. Pressure change inside the inflatable product is transmitted to the pressure switch only after the pressure change passes through the chamber of the housing via the airway and the inlet of the pressure switch.

7 Claims, 11 Drawing Sheets

BUFFER ASSEMBLY FOR A PRESSURE SENSITIVE SWITCH

BACKGROUND OF THE INVENTION

1. Field of the Invention

The present invention relates to an inflatable product with a built-in pressure sensitive switch and a buffer assembly, and more particularly to a buffer assembly in combination with a pressure sensitive switch so as to delay inflation to an inflatable product via an air pump as a result of activation of the pressure sensitive switch.

2. Description of the Prior Art

Inflatable products are full of our daily life. Mattresses, beach-balls, chairs, etc. may all be made of resilient material and inflatable. In order to maintain pressure inside the inflatable product, some inflatable product is equipped with an air pump to provide air into the inflatable product. Thus pressure inside the inflatable product is maintained constant. However, a study shows that, as shown in the pressure-time diagrams of FIGS. 5A to 5E, when one person or a group of persons are jumping up and down on the inflatable, the pressure inside the inflatable product changes constantly, wherein the pressure range 260~320 mmHg is the working area of a pressure switch which is operably connected to an air pump. When the pressure switch senses that the pressure inside the inflatable product is smaller than 260 mmHg, the pressure switch closes to activate the air pump to start pump air into the inflatable product. When the pressure inside the inflatable product reaches 320 mmHg or above, the pressure switch opens to deactivate the air pump to stop pumping air into the inflatable product. Following the up and down movement of the people on the inflatable product, the pressure changes dramatically, which activates and deactivates the air pump frequently. After a period of time, the temperature of the air pump rises and the longevity and safety of the inflatable product becomes an issue to be noted and discussed.

To overcome the shortcomings, the present invention tends to provide an improved buffer assembly in an inflatable product to mitigate the aforementioned problems.

SUMMARY OF THE INVENTION

The primary objective of the present invention is to provide a buffer assembly to delay activation of an air pump so as to maintain safety of the inflatable product.

A further objective of the present invention is that the buffer assembly includes a housing with an airway defined in a bottom face defining the housing to communicate with an inlet of the pressure switch such that pressure change in the inflatable product is transmitted to the pressure switch only after the pressure change goes through the housing first. Thus the delay of the activation of the air pump is achieved.

Still further, the objective of the present invention is to provide a buffer assembly having therein multiple baffles respectively with an aperture apart from each other so as to delay activation of the air pump via the pressure switch.

The buffer assembly further has a serpentine air tube installed inside the housing. A distal end of the air tube is in communication with the airway of the housing and a proximal end of the air tube is in communication with the inlet of the pressure switch.

A further objective of the present invention is that the serpentine air tube is composed of a first air tube and a second air tube separate from each other.

Other objects, advantages and novel features of the invention will become more apparent from the following detailed description when taken in conjunction with the accompanying drawings.

DETAILED DESCRIPTION OF THE PREFERRED EMBODIMENT

Figure 1A:
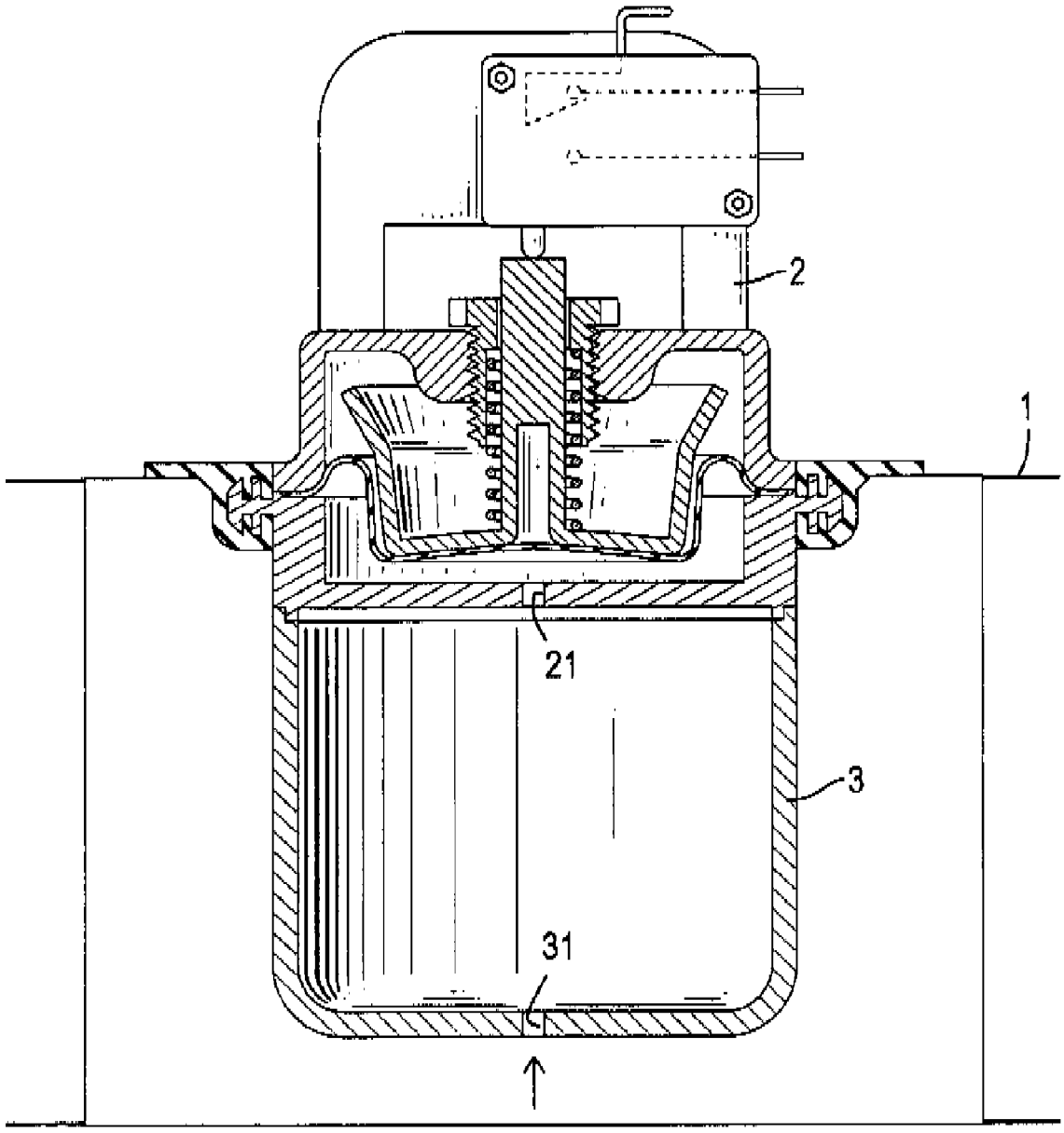
FIG. 1A is a schematic cross sectional view showing the structure of the buffer assembly of the present invention.
Figure 1B:
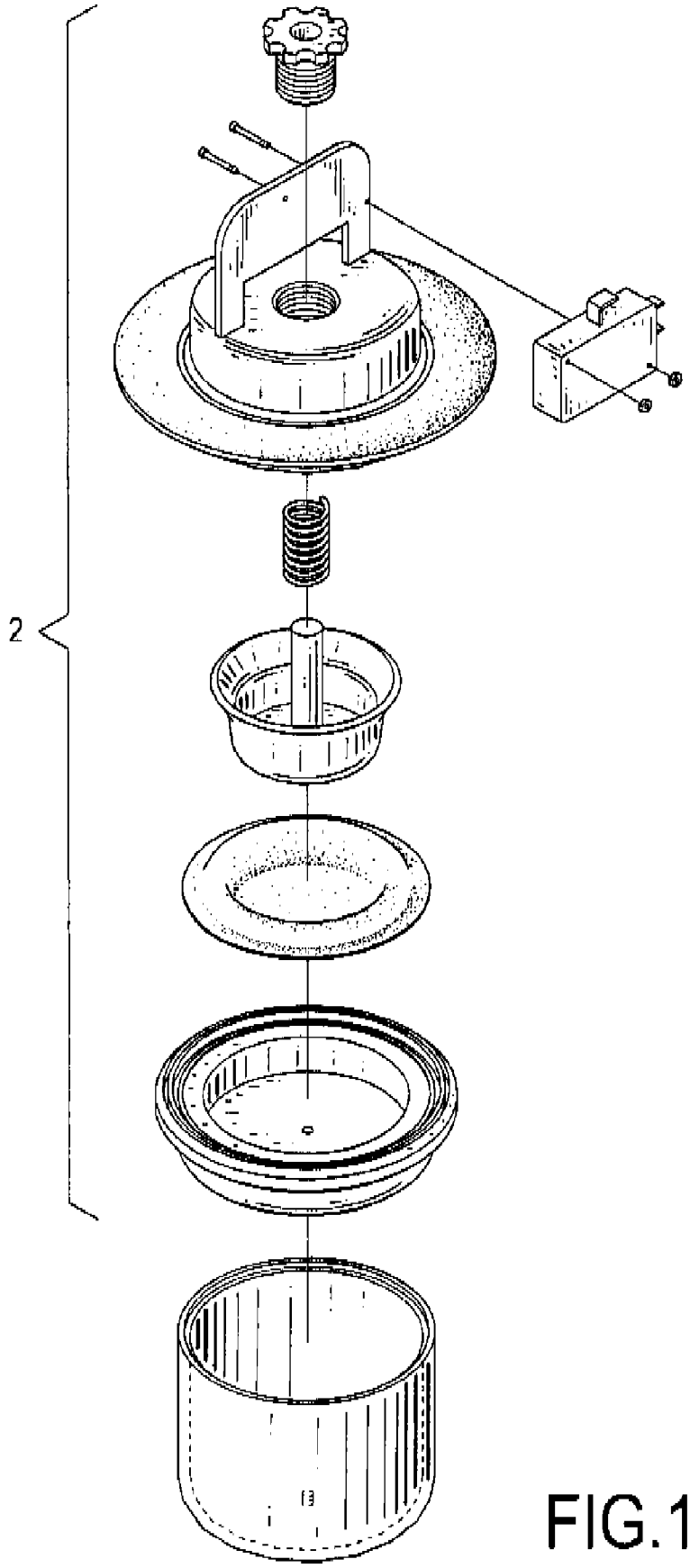
FIG. 1B is an exploded perspective view of the first embodiment in FIG. 1A.

With reference to FIGS. 1A and 1B, it is noted that the buffer assembly in accordance with the present invention includes a housing (3) connected to a pressure switch (2) having therein an inlet (21) defined in a bottom face of the pressure switch (2) to communicate with an interior of the housing (3). It is noted that the pressure switch (2) is integrally formed with and sealingly connected to an inflatable product (1). The housing (3) also has an airway (31) in communication with an interior of the inflatable product (1) and an interior of the housing (3). Thus when the pressure inside the inflatable product (1) is changed, the pressure change has to pass first through the housing (3) and then the pressure change is able to be sensed by the pressure switch (2). Because of the transmission delay of the pressure change inside the housing (3), the activation of the air pump pumping air into the inflatable product (1) to maintain a constant pressure is regulated. That is, the frequency of the air pump activation is decreased.

Figure 2A:
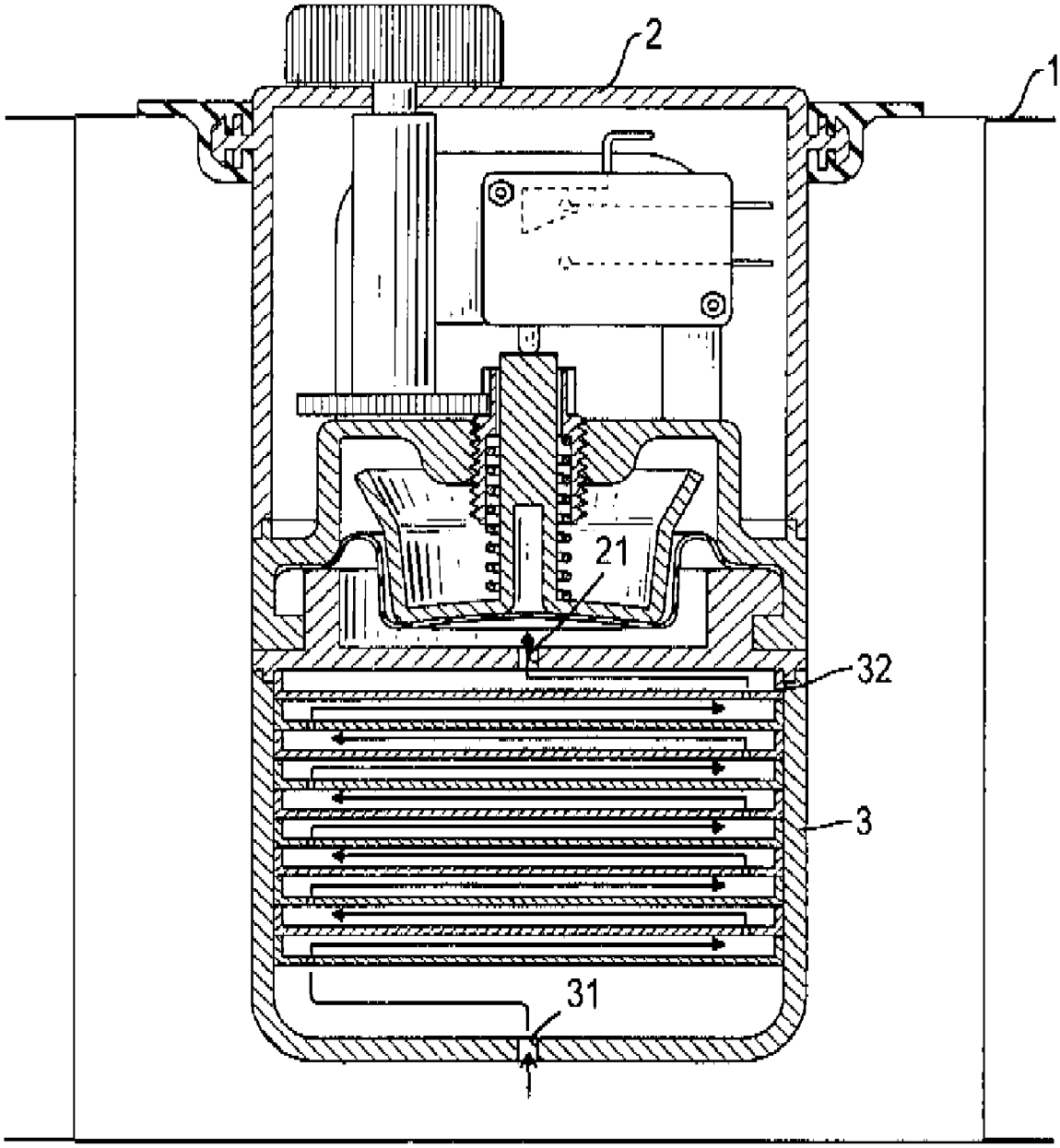
FIG. 2A is a schematic cross sectional view showing the second embodiment of the buffer assembly of the present invention.
Figure 2B:
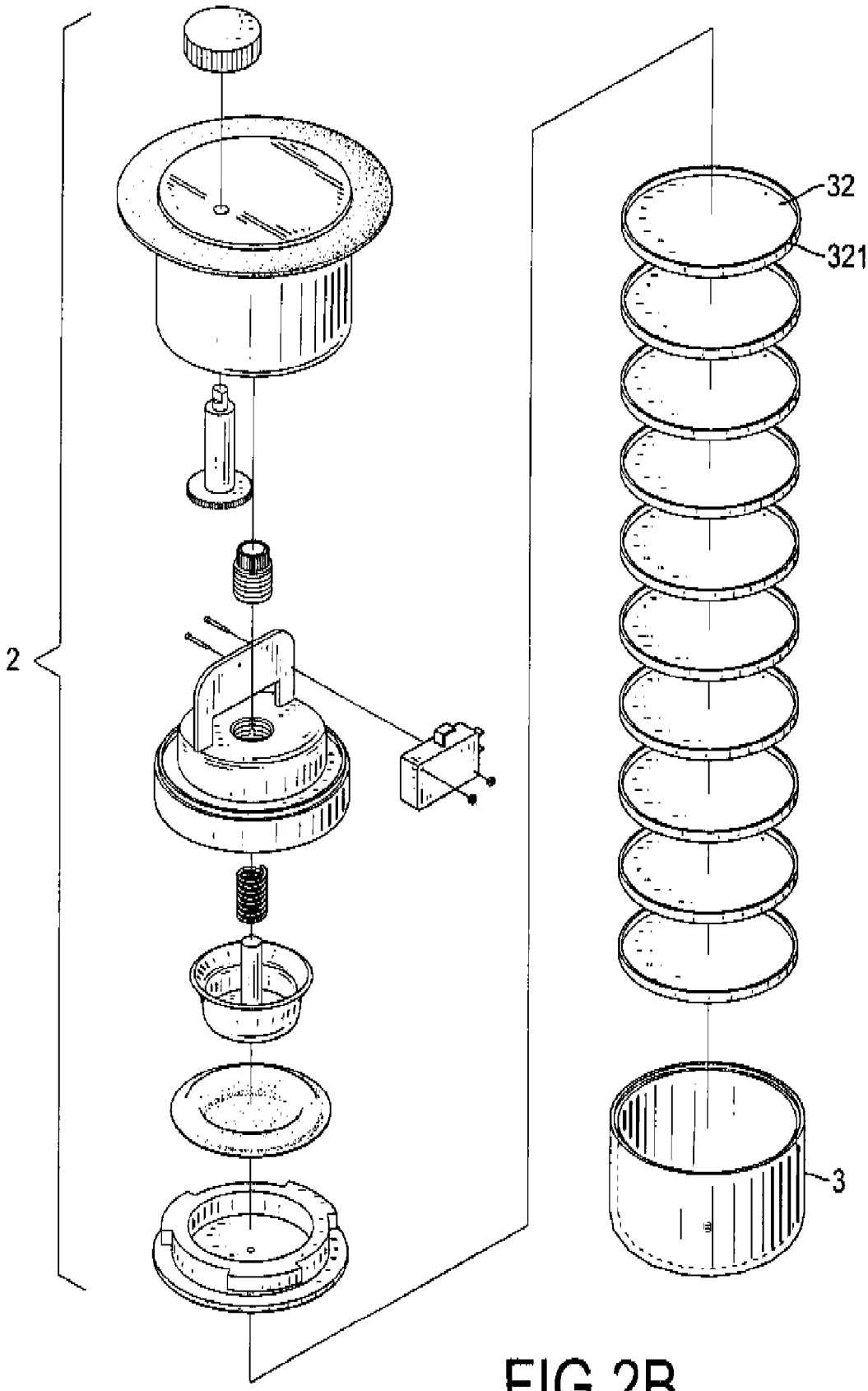
FIG. 2B is an exploded perspective view of the buffer assembly in FIG. 2A.

With reference to FIGS. 2A and 2B, the buffer assembly of the present invention includes a housing (3) adapted to connect to a pressure switch (2) which is embedded inside an inflatable product (1). The housing (3) is provided with multiple baffles (32) installed inside the housing (3) and each baffle (32) has an aperture (321) defined through the baffle (32). In order to delay transmission of pressure change in the inflatable product (1), it is preferably that two adjacent apertures (321) is away from each other as far as possible, e.g. 180 degrees away from each other.

Figure 3A:
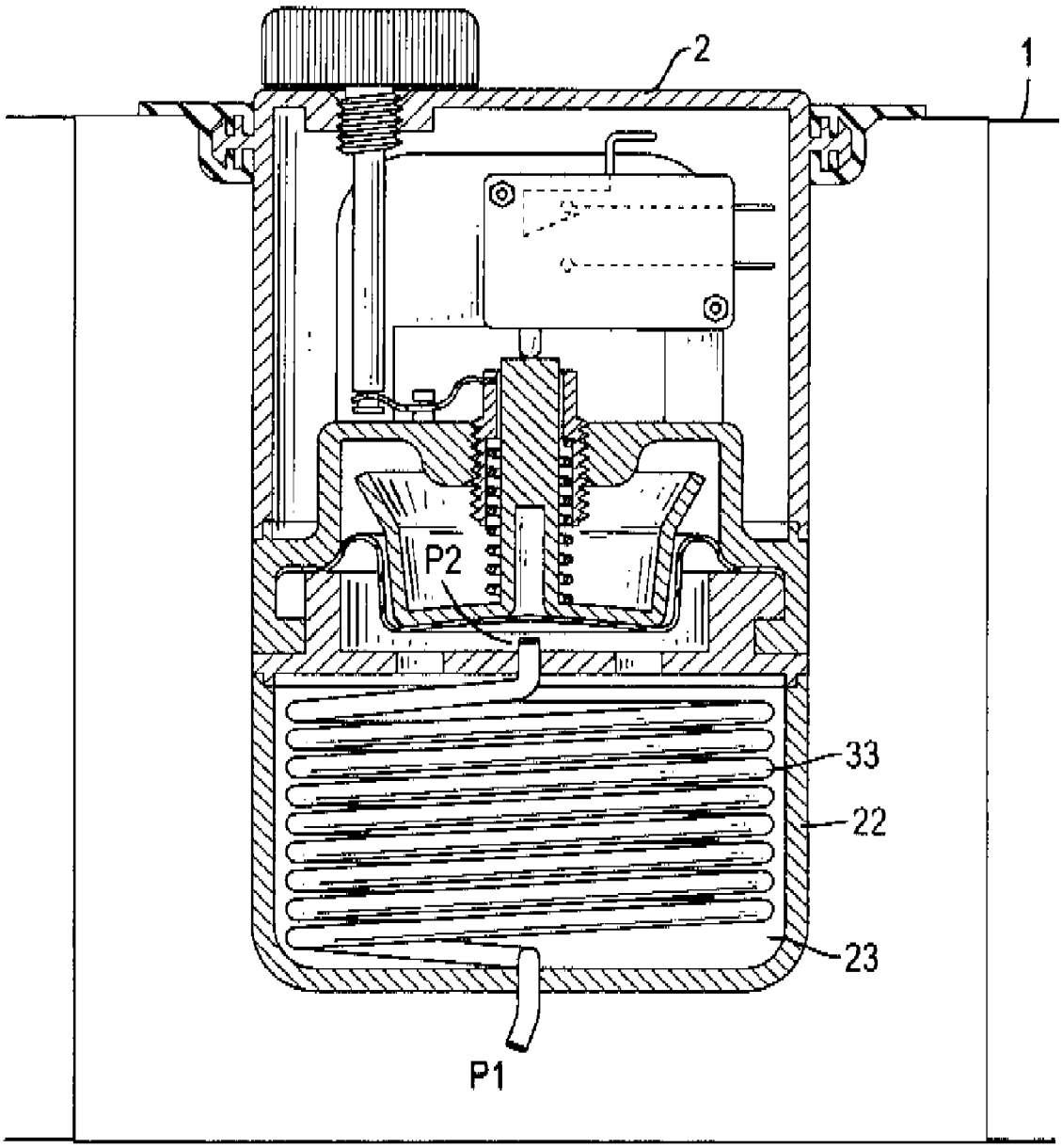
FIG. 3A is a schematic cross sectional view showing the third embodiment of the buffer assembly of the present invention.
Figure 3B:
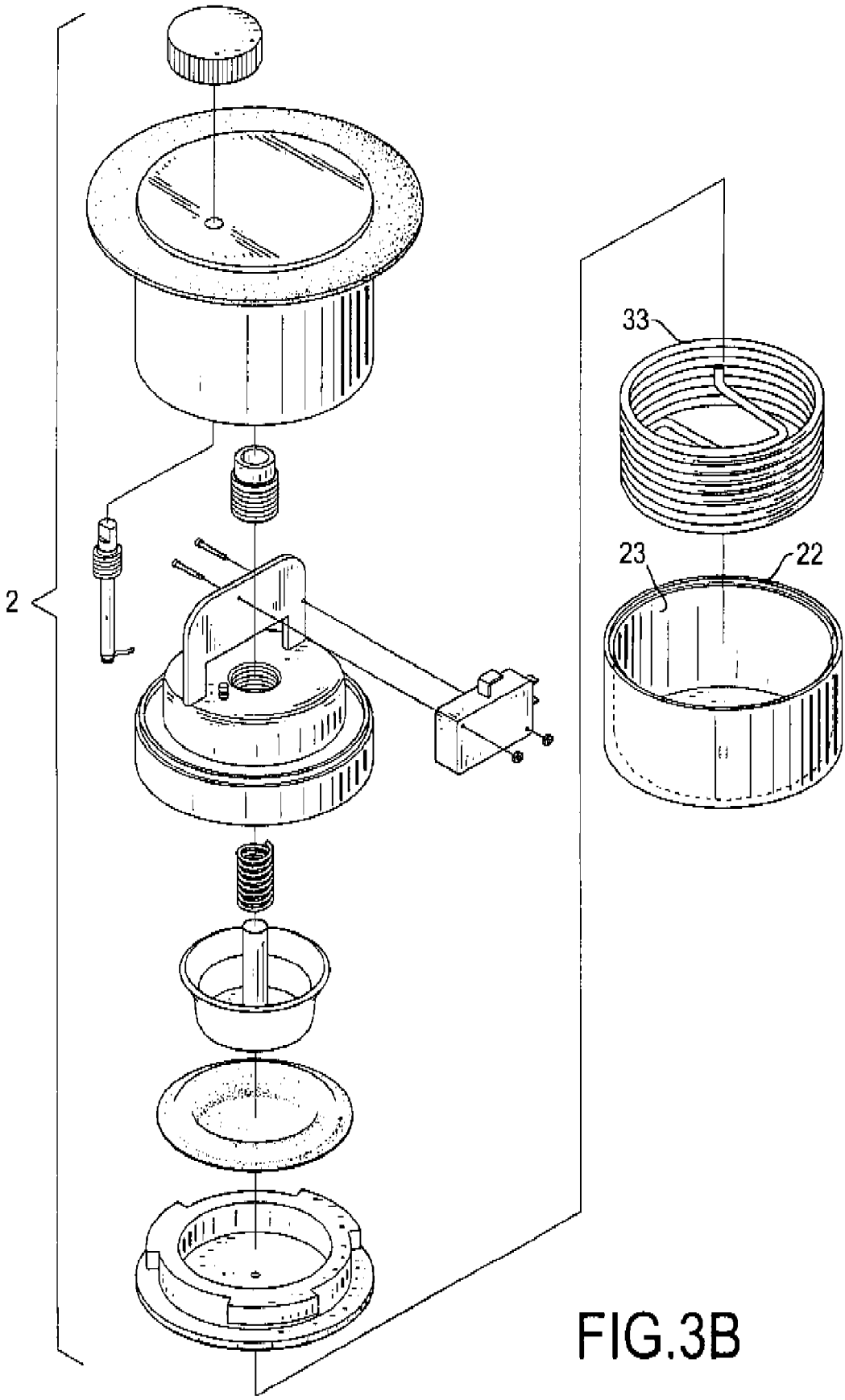
FIG. 3B is an exploded perspective view of the buffer assembly in FIG. 3A.

With reference to FIGS. 3A and 3B, it is noted that the housing (3) of the present invention includes a serpentine air tube (33) inside the chamber of the housing (3). The distal end of the air tube (33) is in communication with the airway (31) and the proximal end of the air tube (33) is in communication with the inlet (21) of the pressure switch (2). By way of this arrangement of the serpentine air tube (33), the pressure change from the inflatable product (1) is delayed in transmission to the pressure switch (2). Thereafter, the delay in transmission of the pressure change from the inflatable product (1) reduces the activation frequency of the air pump.

Figure 4A:
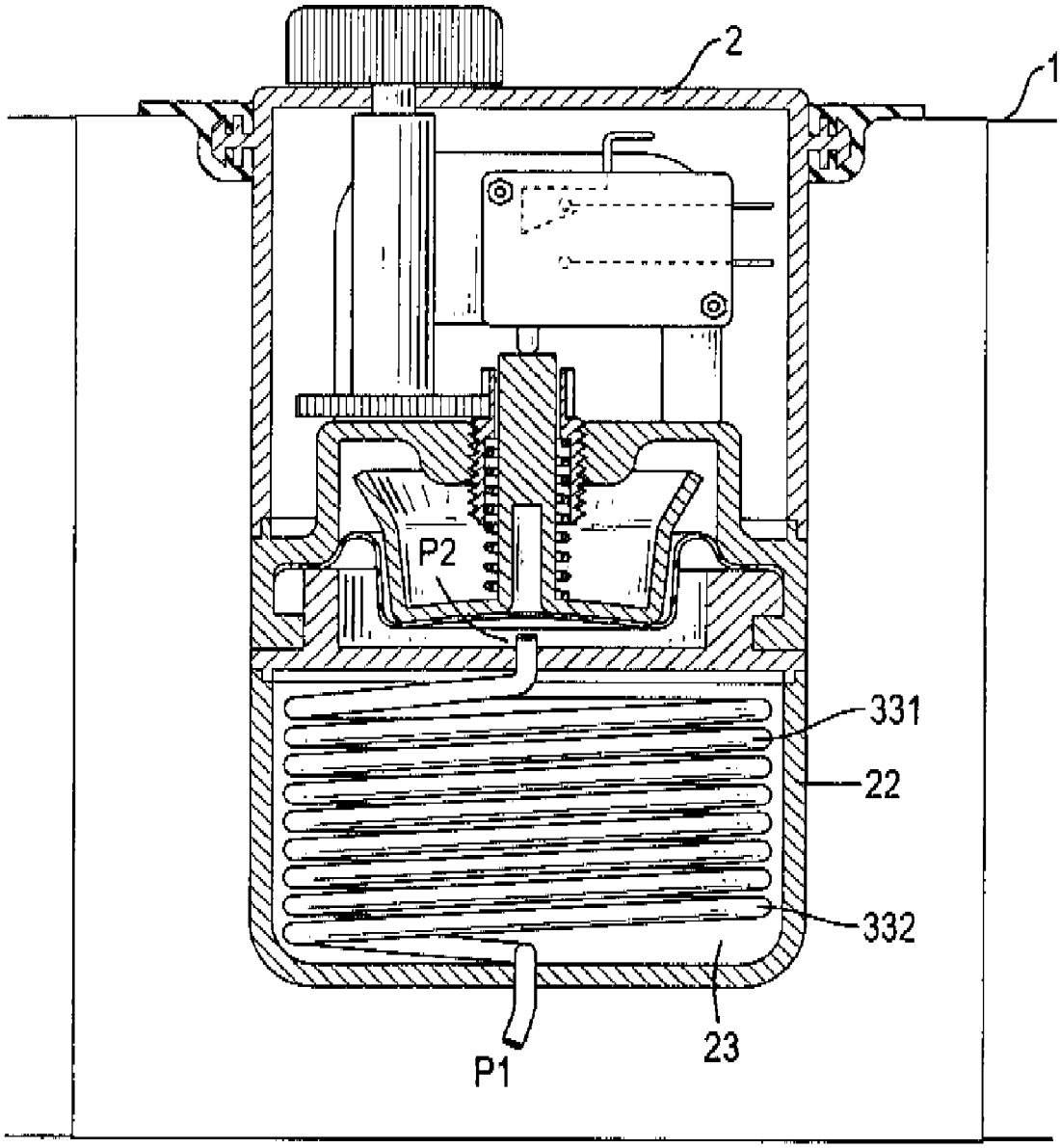
FIG. 4A is a schematic cross sectional view showing the fourth embodiment of the buffer assembly of the present invention.
Figure 4B:
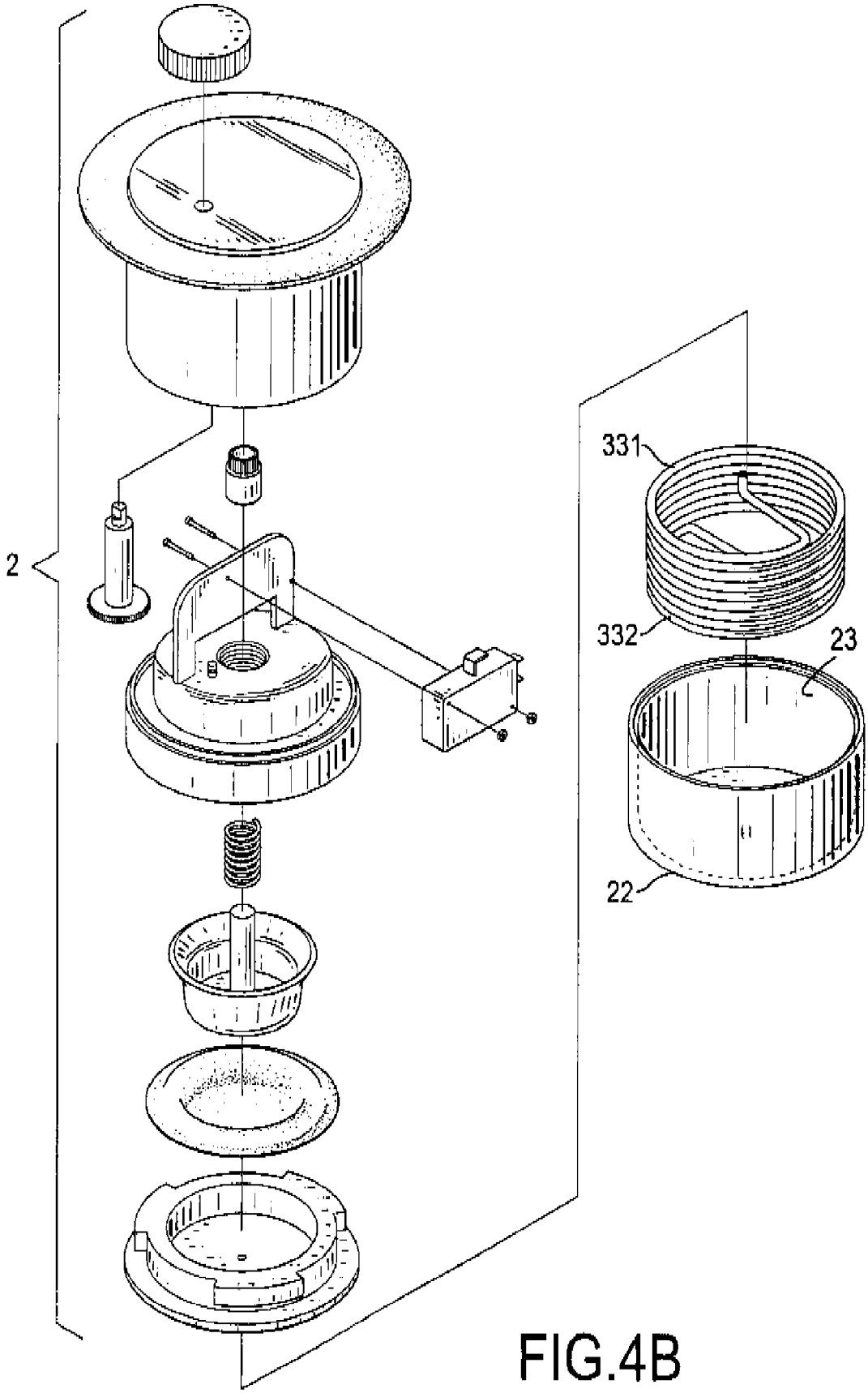
FIG. 4B is an exploded perspective view showing the embodiment in FIG. 4A.
Figure 5A:
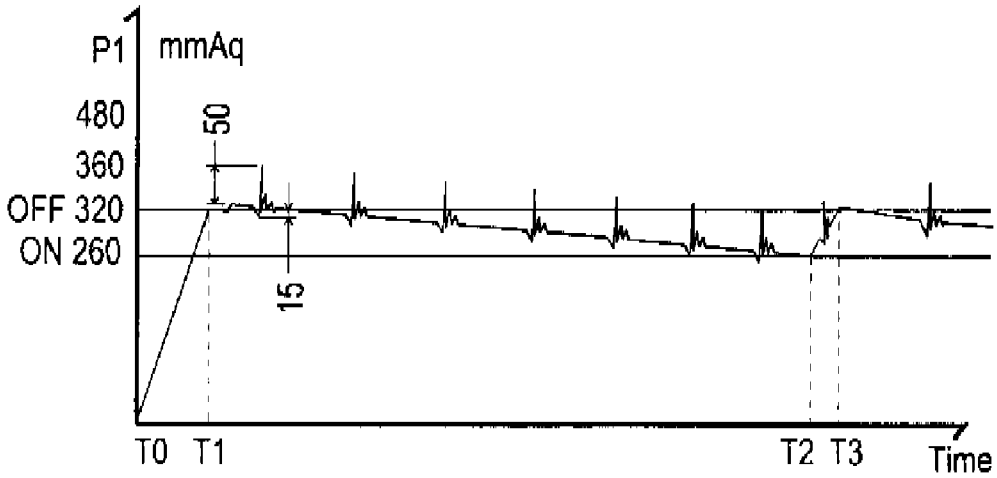
FIGS. 5A~5E are pressure-time diagrams showing the air pump activation frequency in response to pressure change inside the inflatable product before the installation of the buffer assembly.
Figure 5B:
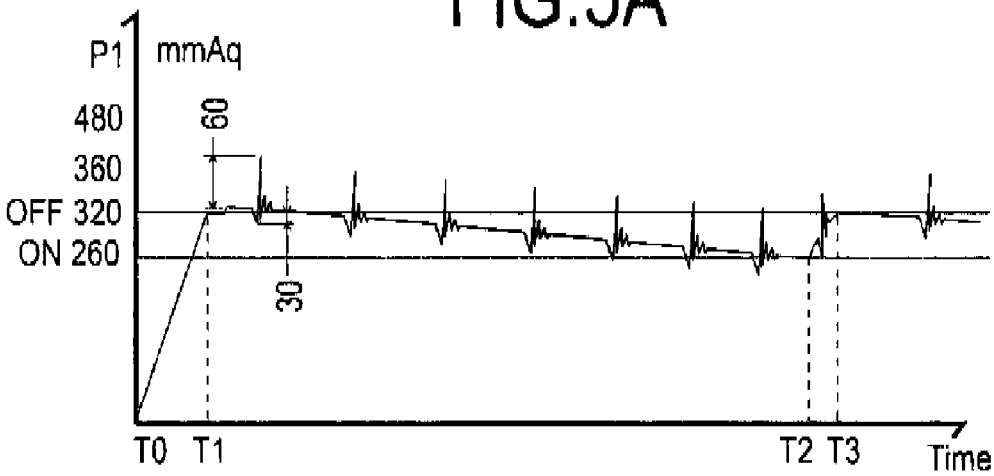
Figure 5C:
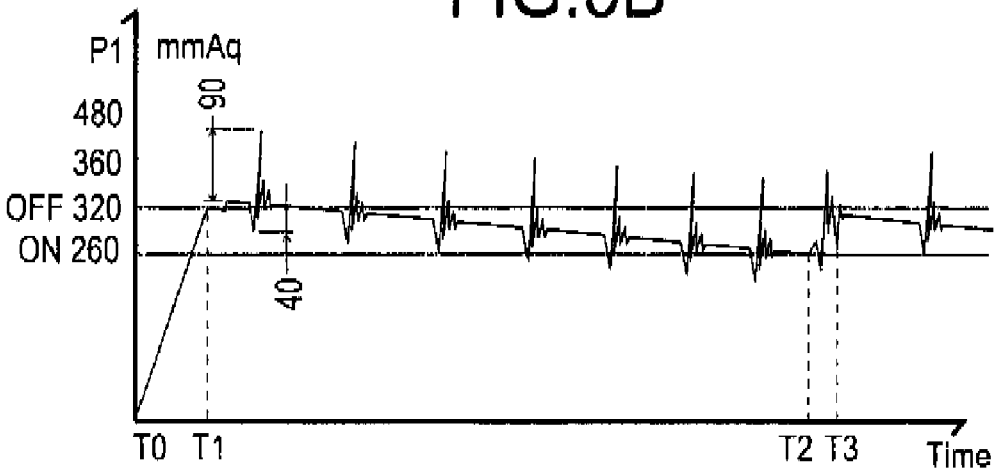
Figure 5D:
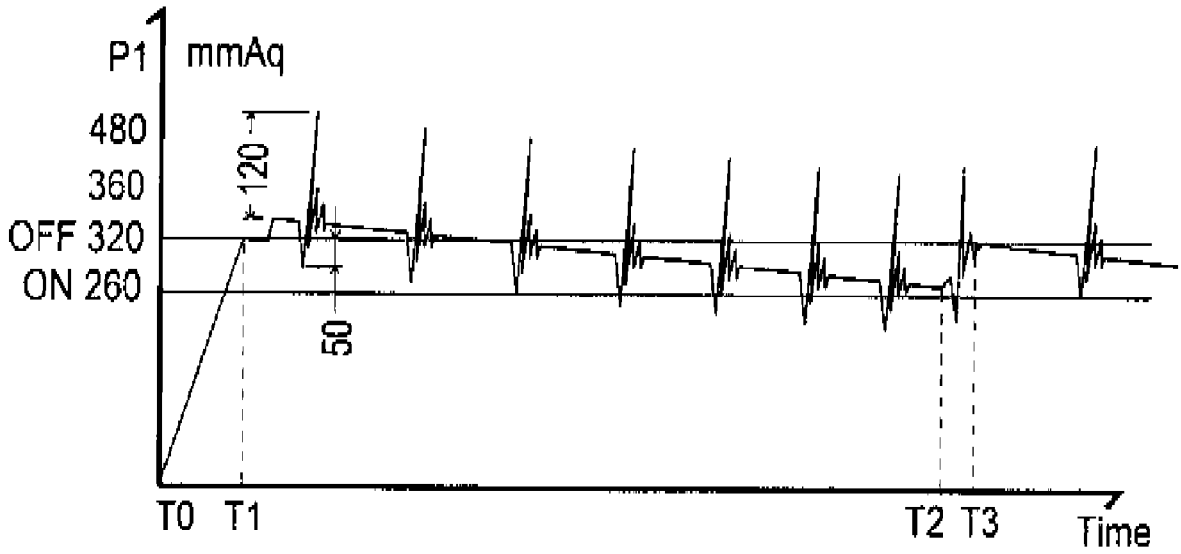
Figure 5E:
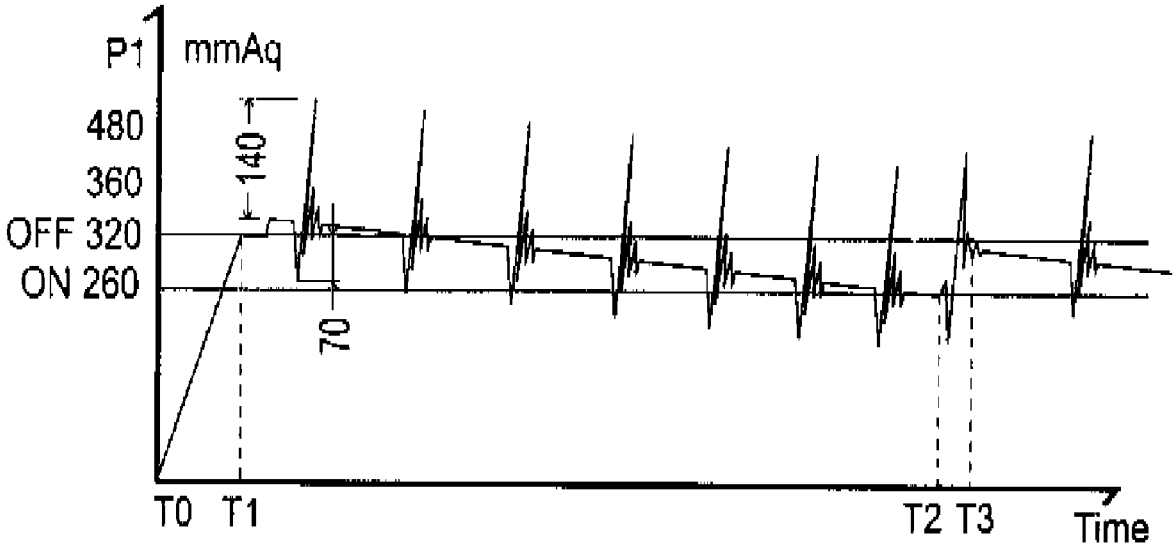

With reference to FIGS. 4A and 4B, it is noted that the housing (3) of the present invention includes a first air tube (331) and a second air tube (332). Both the first air tube (331) and the second air tube (332) are serpentine and respectively have an inlet and an outlet. The outlet of the first air tube (331) is in communication with the inlet (21) of the pressure switch (2) and the outlet of the second air tube (332) is in communication with the inlet of the first air tube (331). Further, the inlet of the second air tube (332) is in communication with the airway (31) of the housing (3).

With the arrangements as set forth in the embodiments which are described in the accompanying drawings, it is noted that the pressure P1 at the airway (31) of the housing (3) is much larger than the pressure P2 at the inlet (21) of the pressure switch (2). That is, the pressure change inside the inflatable product (1) is delayed in transmission to the pressure switch (2) and the delayed pressure change causes the reduce of the air pump activation frequency.

Figure 6:
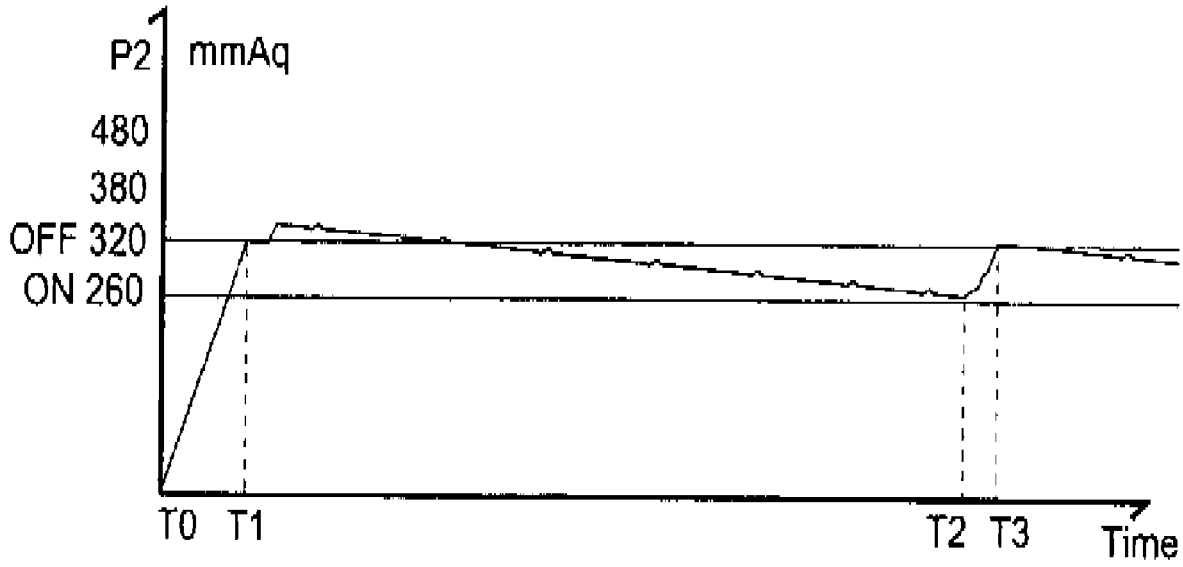
FIG. 6 is a pressure-time diagram showing that the pressure change of the pressure switch is smoothened after the installation of the buffer assembly of the present invention.

With reference to FIG. 6, it is noted that the pressure change curve outside the working area, i.e. 260~320 mmHg, is greatly decreased when compared with the pressure curves in FIGS. 5A~5E. As a result, the life span of the air pump is prolonged.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An inflatable product, comprising:

an inflatable body;

a buffer assembly used for a pressure switch which is built-in to the inflatable body, the buffer assembly comprising:

a housing adapted to connect to the pressure switch and defining therein a chamber and an airway defined on the housing to communicate with an interior of the housing so as to communicate with an inlet of the pressure switch such that pressure change inside the inflatable product is transmitted to the pressure switch only after the pressure change passes through the chamber of the housing via the airway and the inlet of the pressure switch.

2. The inflatable product as claimed in claim 1, wherein the buffer assembly has multiple baffles installed inside the housing to divide the housing into multiple secondary chambers, every adjacent secondary chambers are in communication with each other.

3. The inflatable product as claimed in claim 2, wherein each of the baffles is provided with an aperture so that two adjacent secondary chambers are able to communicate with each other via the apertures.

4. The inflatable product as claimed in claim 1 further comprising an air tube received in the housing and having an inlet in communication with the airway of the housing and an outlet adapted to communicate with the inlet of the pressure switch such that the pressure change inside the inflatable product is transmitted to the pressure switch only after the pressure change passes through the inlet and the outlet of the air tube.

5. The inflatable product as claimed in claim 4, wherein the air tube is composed of a first air tube having an inlet and an outlet and a second air tube having an inlet and an outlet, the outlet of the first air tube is adapted to communicate with the inlet of the pressure switch, the inlet of the second air tube is in communication with the airway of the housing, the outlet of the second air tube is in communication with the inlet of the first air tube so that the pressure change in the inflatable product is delayed in transmission to the pressure switch.

6. The inflatable product as claimed in claim 5, wherein the air tube is serpentine.

7. The inflatable product as claimed in claim 4, wherein the air tube is serpentine.

* * * * *